US009524668B2

(12) United States Patent
Tan et al.

(10) Patent No.: US 9,524,668 B2
(45) Date of Patent: Dec. 20, 2016

(54) AMOLED DRIVING CIRCUIT AND DRIVING METHOD THEREOF, AND DISPLAY DEVICE

(71) Applicants: Chengdu BOE Optoelectronics Technology Co., Ltd., Chengdu, Sichuan (CN); BOE Technology Group Co., Ltd., Beijing (CN)

(72) Inventors: Wen Tan, Beijing (CN); Xiaojing Qi, Beijing (CN)

(73) Assignees: Chengdu BOE Optoelectronics Technology Co., Ltd., Chengdu, Sichuan (CN); BOE Technology Group Co., Ltd., Beijing (CN)

( * ) Notice: Subject to any disclaimer, the term of this patent is extended or adjusted under 35 U.S.C. 154(b) by 21 days.

(21) Appl. No.: 14/234,953

(22) PCT Filed: Oct. 11, 2013

(86) PCT No.: PCT/CN2013/085040

§ 371 (c)(1),
(2) Date: Jan. 24, 2014

(87) PCT Pub. No.: WO2014/201784

PCT Pub. Date: Dec. 24, 2014

(65) Prior Publication Data

US 2015/0015463 A1 Jan. 15, 2015

(30) Foreign Application Priority Data

Jun. 18, 2013 (CN) ..... 2013 1 0240815

(51) Int. Cl.
*G09G 3/32* (2016.01)

(52) U.S. Cl.
CPC ..... *G09G 3/3233* (2013.01); *G09G 3/3241* (2013.01); *G09G 2300/0842* (2013.01);
(Continued)

(58) Field of Classification Search
CPC ..... G09G 3/3233; G09G 2320/0257; G09G 3/3241
(Continued)

(56) References Cited

U.S. PATENT DOCUMENTS 7,046,240 B2 * 5/2006 Kimura ..... G09G 3/2022 257/E21.413
2006/0139259 A1 * 6/2006 Choi ..... G09G 3/3241 345/76

(Continued)

FOREIGN PATENT DOCUMENTS

CN 102708787 A 10/2012
CN 102708798 A 10/2012

(Continued)

OTHER PUBLICATIONS

Notification of the First Office Action and Search Report from the Chinese Patent Office for priority application 201310240815.2 dated Nov. 4, 2014 with English translation.

(Continued)

*Primary Examiner* — Chanh Nguyen
*Assistant Examiner* — Daniel Duong
(74) *Attorney, Agent, or Firm* — Frommer Lawrence & Haug LLP

(57) ABSTRACT

An AMOLED driving circuit, a driving method and a display device, wherein a control unit is connected to a data line and a control line, and is connected to a driving unit via first, second and third nodes; a charging unit is connected to the driving unit via the first node, and is connected to a first power source; the driving unit is connected to one end of a light emitting device, and is connected to the first power source; the other end of the light emitting device is connected to a second power source. The control unit controls a current so as to charge the charging unit through the driving unit, and controls the charging unit so as to supply a voltage to the driving unit through the first node, so that the driving unit is driven by the voltage and drives the light emitting device to emit light.

12 Claims, 4 Drawing Sheets

(52) U.S. Cl.
CPC ..... *G09G 2300/0861* (2013.01); *G09G 2320/0252* (2013.01); *G09G 2320/0257* (2013.01)

(58) Field of Classification Search
USPC ..... 345/78–86
See application file for complete search history.

(56) References Cited

U.S. PATENT DOCUMENTS

| | | | | |
|---|---|---|---|---|
| 2008/0001857 | A1* | 1/2008 | Yoo | G09G 3/3233 345/76 |
| 2014/0117862 | A1* | 5/2014 | Qing | G09G 3/30 315/172 |
| 2014/0354713 | A1* | 12/2014 | Kim | G09G 3/3258 345/694 |

FOREIGN PATENT DOCUMENTS

| | | | | |
|---|---|---|---|---|
| CN | 103325338 | A | | 9/2013 |
| CN | 203338718 | U | | 12/2013 |
| JP | 2009-139552 | A | | 6/2009 |
| KR | 20070000831 | A | * | 1/2007 |

OTHER PUBLICATIONS

Notification of the Second Office Action from the Chinese Patent Office for priority application 201310240815.2 dated Feb. 5, 2015.

* cited by examiner

AMOLED DRIVING CIRCUIT AND DRIVING METHOD THEREOF, AND DISPLAY DEVICE

This application is a 371 of PCT/CN2013/085040 filed on Oct. 11, 2013, which claims priority benefits from Chinese Patent Application Number 201310240815.2 Jun. 18, 2013, the disclosure of which is incorporated herein by reference.

FIELD OF THE INVENTION

The present invention relates to the field of display technology, and more particularly, to an AMOLED driving circuit, a driving method of the AMOLED driving circuit and a display device.

BACKGROUND OF THE INVENTION

With development of display technology, application of active matrix organic light emitting diode (AMOLED) panel becomes more and more important. A light emitting device of AMOLED is an organic light emitting diode (OLED).

Driving schemes of the OLED pixel circuit may be classified into a voltage driving scheme (voltage type) and a current driving scheme (current type). For the voltage type AMOLED, if threshold voltages $V_{TH}$ of driving transistors between different pixel units are different, there is difference between driving currents $I_{OLED}$ driving the OLED to emit light between different pixel units. If the threshold voltage $V_{TH}$ of the driving transistor of the pixel drifts over time, the driving current $I_{OLED}$ that drives the OLED to emit light may change, resulting in afterimage. The driving current $I_{OLED}$ may also be different due to difference in operating voltage between OLEDs caused by non-uniformity of the OLED devices.

To the current type AMOLED, a driving current $I_{DATA}$ is directly supplied from external, and a voltage across a storage capacitor is determined, and thus the driving current $I_{OLED}$ that drives the OLED to emit light is generated. In the conventional current type AMOLED pixel structure, $I_{OLED}$ equals to $I_{DATA}$, while $I_{OLED}$ must fall within a range of operating current of the OLED and is a small current. Accordingly, $I_{DATA}$ is also small, charging speed is low due to large capacitance of the storage capacitor, and charging time is especially very long in the condition of low gray level, resulting in not suitable for AMOLED display in high resolution and high refresh frequency.

SUMMARY OF THE INVENTION

The present invention provides an AMOLED driving circuit and a driving method thereof, and a display device, which can effectively solve the problem of low charging speed and long charging time of the AMOLED driving circuit to the capacitor, so that the AMOLED driving circuit is suitable for AMOLED display in high resolution and high refresh frequency.

In order to solve the above technical problems, the present invention provides an AMOLED driving circuit, including a control unit, a charging unit, a driving unit and a light emitting device, wherein the control unit is connected to a data line and a control line, and the control unit is connected to the driving unit via a first node, a second node and a third node;

the charging unit is connected to the driving unit via the first node, and the charging unit is also connected to a first power source;

the driving unit is connected to one end of the light emitting device, and the driving unit is connected to the first power source; and the other end of the light emitting device is connected to a second power source, wherein when a first control signal flows in the control line, in response to the first control signal, the control unit controls a current from the data line so as to charge the charging unit through the driving unit; and wherein when a second control signal flows in the control line, in response to the second control signal, the control unit controls the charging unit so as to supply a driving voltage to the driving unit through the first node, so that the driving unit is driven by the driving voltage and then drives the light emitting device to emit light.

Optionally, the control unit includes a first switching transistor, a second switching transistor and a third switching transistor;

the gate of the first switching transistor, the gate of the second switching transistor and the gate of the third switching transistor are connected to the control line, a first electrode of the first switching transistor and a first electrode of the second switching transistor are connected to the data line, and a second electrode of the first switching transistor and a first electrode of the third switching transistor are connected to the second node;

a second electrode of the third switching transistor is connected to the third node; and a second electrode of the second switching transistor is connected to the first node.

Optionally, the driving unit includes a first driving transistor, a second driving transistor and a third driving transistor;

the gate of the first driving transistor, the gate of the second driving transistor and the gate of the third driving transistor are connected to the first node;

a first electrode of the first driving transistor is connected to the second node, a first electrode of the third driving transistor is connected to the one end of the light emitting device, a first electrode of the second driving transistor and a second electrode of the third driving transistor are connected to the third node, and a second electrode of the first driving transistor and a second electrode of the second driving transistor are connected to the first power source.

Optionally, the first electrode is a drain and the second electrode is a source.

Optionally, the charging unit includes a storage capacitor, one end of the storage capacitor is connected to the first node, and the other end of the storage capacitor is connected to the first power source.

Optionally, the light emitting device comprises an organic light emitting diode (OLED).

Optionally, the first driving transistor, the second driving transistor, the third driving transistor, the first switching transistor, the second switching transistor and the third switching transistor are all N type thin film transistors or are all P type thin film transistors.

Optionally, the second driving transistor operates in a linear region and the third driving transistor operates in a saturation region, during a light emitting stage of the light emitting device.

Optionally, a ratio between a data current of the data line and a driving current of the light emitting device is $$\frac{I_{DATA}}{I_{OLED}} = \frac{(K_2 + K_1)\cdot(K_2 + K_3)}{K_2 \cdot K_3},$$

where $K_1$ is a current coefficient of the first driving transistor, $K_2$ is a current coefficient of the second driving transistor, $K_3$ is a current coefficient of the third driving transistor, $I_{DATA}$ is the data current supplied by the data line, and $I_{OLED}$ is the driving current that flows through the light emitting device.

To achieve the above objects, the present invention provides a driving method of an AMOLED driving circuit, wherein the driving method is based on the AMOLED driving circuit including a control unit, a charging unit, a driving unit and a light emitting device, the driving method includes:

when a first control signal flows in a control line, in response to the first control signal, the control unit controls a current from a data line so as to charge the charging unit through the driving unit; and when a second control signal flows in the control line, the control unit controls the charging unit to supply a voltage to the driving unit in response to the second control signal, so that the driving unit drives the light emitting device to emit light.

Optionally, the control unit includes a first switching transistor, a second switching transistor and a third switching transistor; the driving unit includes a first driving transistor, a second driving transistor and a third driving transistor; and the charging unit includes a storage capacitor, the step of the control unit controlling a current from a data line so as to charge the charging unit through the driving unit includes:

the first switching transistor, the second switching transistor and the third switching transistor are turned on under control of the control line, the first driving transistor and the second driving transistor are turned on, and the third driving transistor is turned off, so that the storage capacitor is charged by the data line through the first driving transistor and the second driving transistor in parallel.

Optionally, the control unit includes a first switching transistor, a second switching transistor and a third switching transistor; the driving unit includes a first driving transistor, a second driving transistor and a third driving transistor; and the charging unit includes a storage capacitor, the step of the control unit controlling the charging unit so as to supply a voltage to the driving unit so that the driving unit driving the light emitting device to emit light includes:

the first switching transistor, the second switching transistor and the third switching transistor are turned off under control of the control line, the storage capacitor supplies a gate voltage to the second driving transistor and the third driving transistor, and the second driving transistor and the third driving transistor in series drive the light emitting device to emit light.

To achieve the above objects, the present invention provides a display device including the AMOLED driving circuit as described above.

The present invention provides an AMOLED driving circuit and a driving method thereof and a display device, the AMOLED driving circuit includes a control unit, a charging unit, a driving unit and a light emitting device. The control unit is connected to a data line and a control line, and the control unit is connected to the driving unit via a first node, a second node and a third node. The charging unit is connected to the driving unit via the first node, and the charging unit is connected to a first power source. The driving unit is connected to one end of the light emitting device, and the driving unit is also connected to the first power source. The other end of the light emitting device is connected to a second power source. When a first control signal flows in the control line, the control unit controls a current from the data line in response to the first control signal, so that the controlled current charges the charging unit through the driving unit. When a second control signal flows in the control line, the control unit controls the charging unit in response to the second control signal, so that the charging unit supplies a driving voltage to the driving unit through the first node, and so that the driving unit is driven by the driving voltage and then drives the light emitting device to emit light.

With configuration of the above circuit structure according to the present invention, a ratio between the data current of the data line and the driving current of the light emitting device is adjustable, and thus the ratio between the two currents may be increased, that is, the ratio between the data current of the data line and the driving current of the light emitting device may be increased by adjusting the current coefficients of the driving transistors in the driving unit, thus the current for charging the charging unit may be increased, and the problem of low charging speed and long charging time of the AMOLED driving circuit to the capacitor may be effectively solved, so that the AMOLED driving circuit is suitable for AMOLED display in high resolution and high refresh frequency.

DESCRIPTION OF THE PREFERRED EMBODIMENT

Hereinafter, an AMOLED driving circuit, a driving method for the AMOLED driving circuit and a display device according to the present invention will be described in detail with reference to the accompanying drawings, for the person skilled in the art to better understand the technical solution of the present invention.

Figure 1:
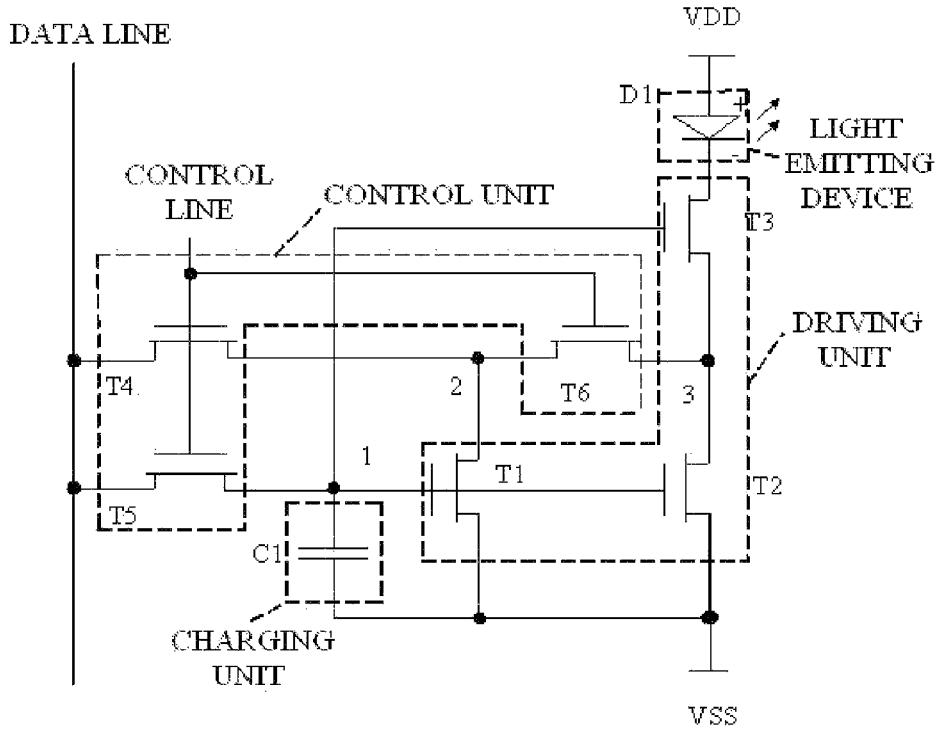
FIG. 1 is a diagram illustrating a circuit structure of an AMOLED driving circuit according to a first embodiment of the present invention.

FIG. 1 is a diagram illustrating a circuit structure of an AMOLED driving circuit according to a first embodiment of the present invention. As shown in FIG. 1, the AMOLED driving circuit includes a control unit, a charging unit, a driving unit and a light emitting device D1. The control unit is connected to a data line and a control line, and the control unit is connected to the driving unit via a first node 1, a second node 2 and a third node 3. The charging unit is connected to the driving unit via the first node 1, and the charging unit is connected to a first power source $V_{SS}$. The driving unit is connected to the first power source $V_{SS}$, and the driving unit is connected to one end of the light emitting device D1. The other end of the light emitting device D1 is connected to a second power source $V_{DD}$. When a first control signal flows in the control line, in response to the first control signal, the control unit controls a current from the data line so as to charge the charging unit through the driving unit. When a second control signal flows in the control line, in response to the second control signal, the control unit controls the charging unit so as to supply a driving voltage to the driving unit through the first node, so that the driving unit is driven by the driving voltage and then drives the light emitting device to emit light.

More specifically, the control unit includes a first switching transistor T4, a second switching transistor T5 and a third switching transistor T6. The gate of the first switching transistor T4, the gate of the second switching transistor T5 and the gate of the third switching transistor T6 are connected to the control line. The drain of the first switching transistor T4 and the drain of the second switching transistor T5 are connected to the data line. The source of the first switching transistor T4 and the drain of the third switching transistor T6 are connected to the second node 2. The source of the third switching transistor T6 is connected to the third node 3. The source of the second switching transistor T5 is connected to the first node 1.

Further, the driving unit includes a first driving transistor T1, a second driving transistor T2 and a third driving transistor T3. The gate of the first driving transistor Ti and the gate of the second driving transistor T2 are connected to the first node 1. The source of the first driving transistor Ti and the source of the second driving transistor T2 are connected to the first power source $V_{SS}$. The drain of the first driving transistor T1 is connected to the second node 2. The source of the third driving transistor T3 and the drain of the second driving transistor T2 are connected to the third node 3. The gate of the third driving transistor T3 is connected to the first node 1. The drain of the third driving transistor T3 is connected to the one end of the light emitting device D1.

Further, the charging unit includes a storage capacitor C1, one end of the storage capacitor C1 is connected to the first node 1, and the other end of the storage capacitor C1 is connected to the first power source $V_{SS}$.

In this embodiment, the first driving transistor T1, the second driving transistor T2, the third driving transistor T3, the first switching transistor T4, the second switching transistor T5 and the third switching transistor T6 are N type thin film transistor, and a first electrode is a drain and a second electrode is a source.

The drain of the third driving transistor T3 is connected to one end of the light emitting device D1, and the other end and of the light emitting device D1 is connected to the second power source $V_{DD}$. A voltage supplied by the second power source is $V_{DD}$, and a voltage supplied by the first power source is a reference voltage $V_{SS}$. The voltage supplied by the second power source may be higher than the reference voltage, wherein $V_{DD}$ may be a high level, and accordingly, $V_{SS}$ as the reference voltage may be a low level. A voltage supplied by the data line is $V_{DATA}$, and a voltage supplied by the control line is $V_{SCAN}$.

Figure 2:
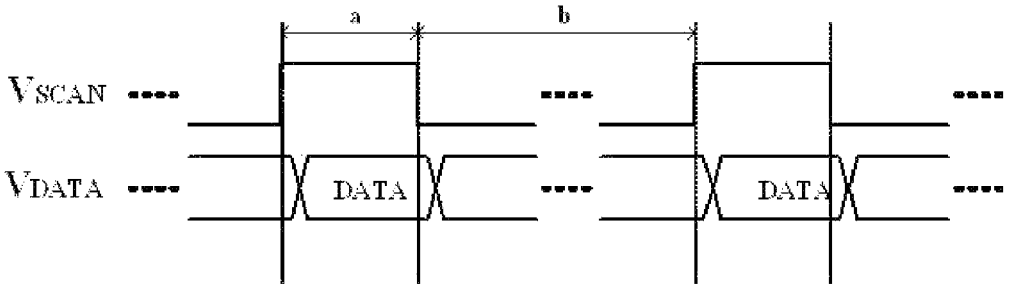
FIG. 2 is a diagram of an input voltage of the AMOLED driving circuit according to the first embodiment.
Figure 3:
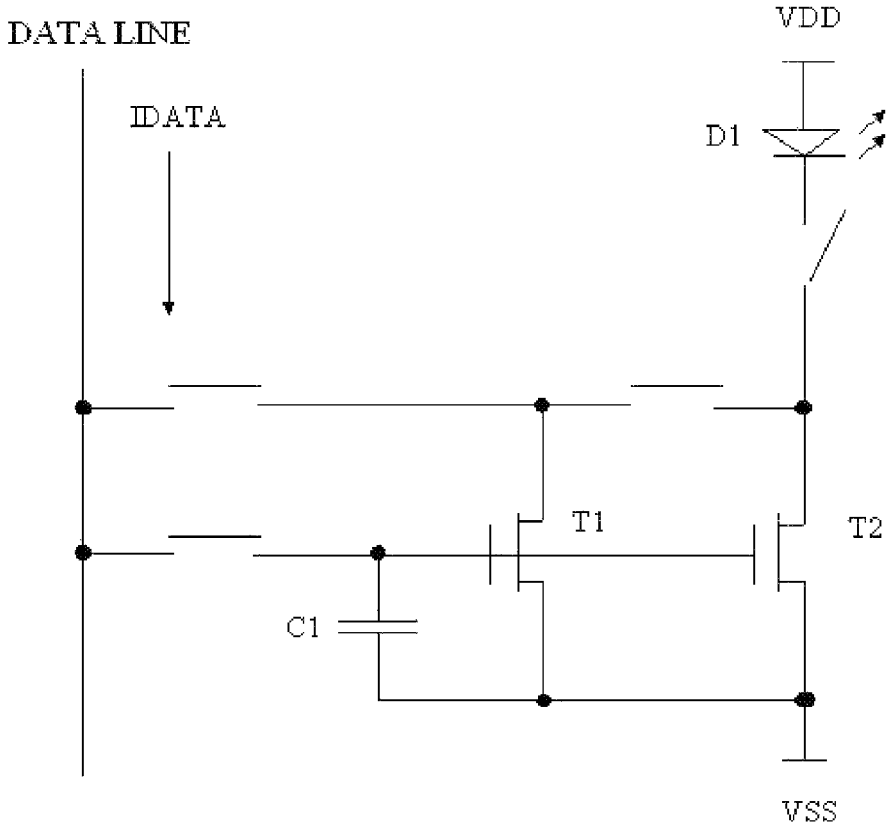
FIG. 3 is an equivalent circuit diagram of the AMOLED driving circuit in charging stage according to the first embodiment.
Figure 4:
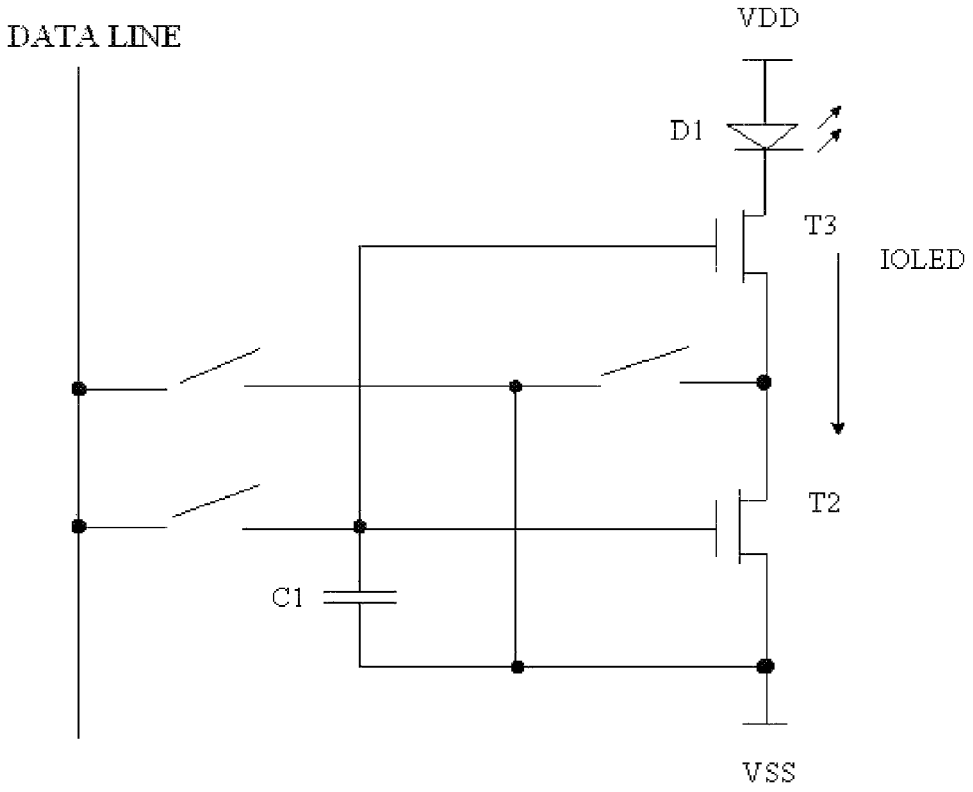
FIG. 4 is an equivalent circuit diagram of the AMOLED driving circuit in discharging stage according to the first embodiment.

Hereinafter, an operating procedure of the AMOLED driving circuit of the embodiment will be described in detail with reference to FIG. 2 to FIG. 4. FIG. 2 is a diagram of an input voltage of the AMOLED driving circuit in FIG. 1. As shown in FIG. 2, a stage a represents a charging stage of the AMOLED driving circuit, and a stage b represents a discharging stage (or light emitting stage) of the AMOLED driving circuit. FIG. 3 is an equivalent circuit diagram of the AMOLED driving circuit in FIG. 1 in charging stage. FIG. 4 is an equivalent circuit diagram of the AMOLED driving circuit in FIG. 1 in discharging stage. When the voltage $V_{SCAN}$ supplied by the control line is a high level (the first control signal), the first switching transistor T4, the second switching transistor T5 and the third switching transistor T6 are turned on, and at this time, the equivalent circuit diagram of the AMOLED driving circuit in FIG. 1 in charging stage is shown in FIG. 3, a data current $I_{DATA}$ supplied by the data line charges the capacitor C1. When the voltage $V_{SCAN}$ supplied by the control line is a low level (the second control signal), the first switching transistor T4, the second switching transistor T5 and the third switching transistor T6 are turned off, and the capacitor C1 supplies the driving voltage so that the light emitting device D1 emits light.

Referring to FIG. 3, in the charging stage, that is, the charging stage of the AMOLED driving circuit, the first driving transistor T1 and the second driving transistor T2 are turned on. $V_{G_T3}$ is a gate voltage of the third driving transistor T3, $V_{G_T2}$ is a gate voltage of the second driving transistor T2, $V_{D_T2}$ is a drain voltage of the second driving transistor T2, $V_{S_T3}$ is a source voltage of the third driving transistor T3, and $V_{G_T3}=V_{G_T2}$ $V_{D_T2}=V_{S_T3}$, at this time, the third driving transistor T3 is turned off, $I_{DATA}=1/2(K_1$ $K_2)(V_{GS}$ $V_{TH})^2$, where $K_1$ is a current coefficient of the first driving transistor T1, $K_2$ is a current coefficient of the second driving transistor T2, $I_{DATA}$ is the data current supplied by the data line, $V_{GS}$ is the gate voltage of the first driving transistor T1 and the second driving transistor T2, and the threshold voltages of the first driving transistor T1, the second driving transistor T2 and the third driving transistor T3 are the same and are $V_{TH}$.

Referring to FIG. 4, in the discharging stage, the second driving transistor T2 and the third driving transistor T3 are turned on in series, wherein the second driving transistor T2 operates in a linear region and the third driving transistor T3 operates in a saturation region, and $I_{OLED}=I_{DS_T2}$ $I_{DS_T3}=$, where $I_{OLED}$ is the driving current that flows through the light emitting device D1, $I_{DS_T2}$ is a source-drain current that flows through the second driving transistor T2, and $I_{DS_T3}$ is a source-drain current that flows through the third driving transistor T3.

At this time, $I_{DS_T2}=K_2(\cdot V_{GS}$ $V_{TH})$ $V\cdot_{DS_T2}1/2\cdot K_2\cdot V_{DS_T2}{}^2$, where $V_{DS_T2}$ is a source-drain voltage of the second driving transistor T2;

$I_{DS_T3}=1/2\cdot K_3(V_{GS_T3}$ $V_{TH})^2$, where $V_{GS_T3}$ is a gate-source voltage of the third driving transistor T3, and $K_3$ is a current coefficient of the third driving transistor T3;

$$\text{then, } K_2\cdot(V_{GS}-V_{TH})\cdot V_{DS_T2}-\frac{1}{2}\cdot K_2\cdot V_{DS_T2}^2=\frac{1}{2}K_3\cdot(V_{GS}-V_{TH})^2,$$

$$\text{since } V_{GS_T3}+V_{DS_T2}=V_{GS},\ V_{DS_T2}=V_{GS}-V_{GS_T3},$$

$$\begin{aligned}
I_{DS_T2} &= K_2(V_{GS}-V_{TH})\cdot(V_{GS}-V_{GS_T3})-\frac{1}{2}K_2(V_{GS}-V_{GS_T3})^2\\
&= \frac{K_2}{2}\cdot[2\cdot(V_{GS}-V_{TH})\cdot(V_{GS}-V_{GS_T3})-(V_{GS}-V_{GS_T3})^2]\\
&= \frac{K_2}{2}\cdot[2\cdot(V_{GS}^2-V_{TH}\cdot V_{GS}-V_{GS}\cdot V_{GS_T3}+V_{GS_T3}\cdot V_{TH})-\\
&\quad (V_{GS}^2-2\cdot V_{GS_T3}\cdot V_{GS}+V_{GS_T3}^2)]\\
&= \frac{K_2}{2}[V_{GS}^2-2V_{TH}\cdot V_{GS}+V_{TH}^2-V_{TH}^2+2V_{GS_T3}\cdot V_{TH}-V_{GS_T3}^2]\\
&= \frac{K_2}{2}(V_{GS}-V_{TH})^2-\frac{K_2}{2}(V_{GS_T3}-V_{TH})^2\\
&= \frac{K_2}{(K_2+K_1)}\cdot\frac{K_2K_1}{2}(V_{GS}-V_{TH})^2-\frac{K_2}{K_3}\cdot\frac{K_3}{2}(V_{GS_T3}-V_{TH})^2\\
&= \frac{K_2}{K_1+K_2}\cdot I_{DATA}-\frac{K_2}{K_3}\cdot I_{DS_T3}
\end{aligned}$$

-continued $$\text{therefore, } I_{DS_T2} = \frac{K_2}{K_1 + K_2} \cdot I_{DATA} - \frac{K_2}{K_3} \cdot I_{DS_T3},$$

$$I_{OLED} = \frac{K_2}{K_1 + K_2} \cdot I_{DATA} - \frac{K_2}{K_3} \cdot I_{DS_T3},$$

$$\text{since } I_{OLED} = I_{DS_T2} = I_{DS_T3},$$

$$\frac{K_2 + K_3}{K_3} \cdot I_{OLED} = \frac{K_2}{K_1 + K_2} \cdot I_{DATA},$$

$$\frac{I_{DATA}}{I_{OLED}} = \frac{(K_2 + K_1) \cdot (K_2 + K_3)}{K_2 \cdot K_3},$$

where $K_1$ is the current coefficient of the first driving transistor T1, $K_2$ is the current coefficient of the second driving transistor T2, $K_3$ is the current coefficient of the third driving transistor T3, $I_{DATA}$ is the data current supplied by the data line, and $I_{OLED}$ is the driving current that flows through the light emitting device.

From the above derivation of the formula, since the second driving transistor T2, the third driving transistor T3 and the light emitting device D1 are connected in series, the source-drain current flowing through the second driving transistor T2, the source-drain current flowing through the third driving transistor T3 and the driving current flowing through the light emitting device D1 are the same, i.e., $I_{OLED}=I_{DS_T2}$ $I_{DS_T3}=$. A common gate voltage of the first driving transistor T1 and the second driving transistor T2 equals to the sum of the gate-source voltage of the third driving transistor T3 and the source-drain voltage of the second driving transistor T2, i.e., $V_{GS_T3}+V_{DS_T2}=V_{GS}$. Therefore, in the above derivation, $V_{GS}$ and $V_{TH}$ are canceled out, that is, a ratio between $I_{DATA}$ and $I_{OLED}$ depends on the values of the current coefficient $K_1$ of the first driving transistor T1, the current coefficient $K_2$ of the second driving transistor T2 and the current coefficient $K_3$ of the third driving transistor T3. However, in the conventional current type AMOLED pixel structure, $I_{OLED}$ equals to $I_{DATA}$, since $I_{OLED}$ is relatively small, $I_{DATA}$ is also relatively small, and thus there exists the technical problem of slow charging speed and long charging time.

During the stage b shown in FIG. 2, i.e., the discharging stage of the AMOLED driving circuit, the light emitting device emits light, the voltage $V_{SCAN}$ supplied by the control line is low level, and the first switching transistor T4, the second switching transistor T5 and the third switching transistor T6 are turned off, at this time, the equivalent circuit diagram of the AMOLED driving circuit in FIG. 1 in the discharging stage is shown in FIG. 4. According to a ratio between the data current and the driving current, i.e., $$\frac{I_{DATA}}{I_{OLED}} = \frac{(K_2 + K_1) \cdot (K_2 + K_3)}{K_2 \cdot K_3},$$

as can be seen from this formula, a large ratio between $I_{DATA}$ and $I_{OLED}$ can be obtained by selecting the values of $K_1$, $K_2$ and $K_3$, and a large data current $I_{DATA}$ can be obtained while ensuring the driving current falls within the range of operating current of the light emitting device D1, thereby charging for the capacitor Cl is speeded up.

The AMOLED driving circuit according to this embodiment includes the control unit, the charging unit, the driving unit and the light emitting device. The control unit is connected to the data line and the control line, and the control unit is connected to the driving unit via the first node 1, the second node 2 and the third node 3. The charging unit is connected to the driving unit via the first node 1, and the charging unit is also connected to the first power source. The driving unit is connected to one end of the light emitting device, and the driving unit is connected to the first power source. The other end of the light emitting device is connected to the second power source. When the first control signal flows in the control line, in response to the first control signal, the control unit controls the current from the data line so that the controlled current charges the charging unit through the driving unit. When the second control signal flows in the control line, in response to the second control signal, the control unit controls the charging unit so that the charging unit supplies the driving voltage to the driving unit through the first node, and so that the driving unit is driven by the driving voltage and then drives the light emitting device to emit light.

In the driving circuit structure according to this embodiment of the present invention, the ratio between the data current of the data line and the driving current of the light emitting device may be increased by adjusting the current coefficients of the driving transistors in the driving unit, thus the current for charging the charging unit may be increased, and the problem of low charging speed of the AMOLED pixel due to low charging current may be effectively solved, so that AMOLED display is suitable for condition of high resolution and high refresh frequency.

Figure 5:
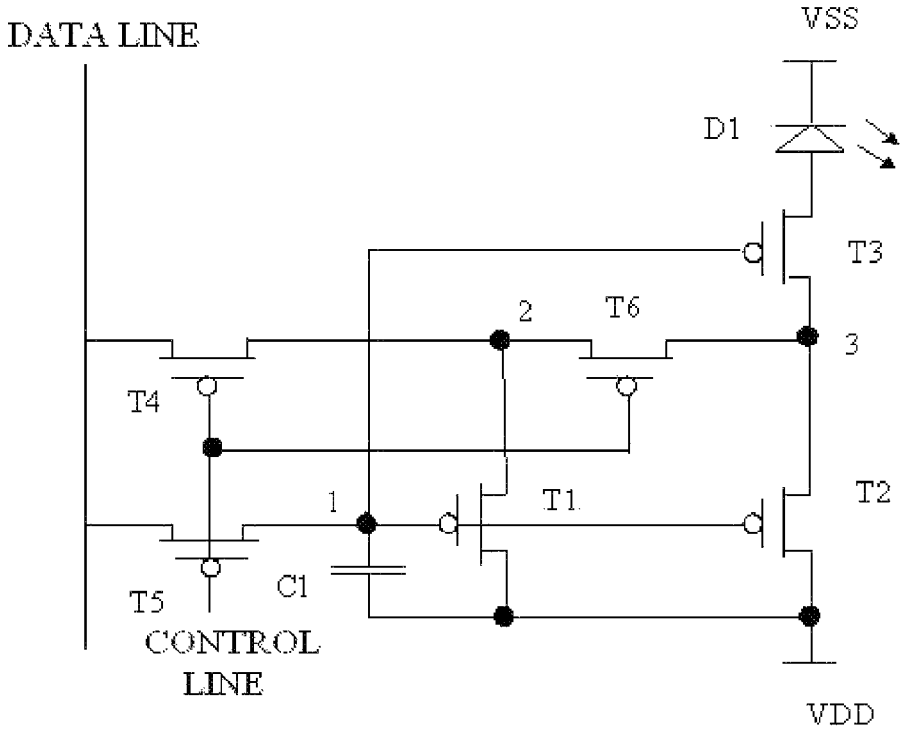
FIG. 5 is a diagram illustrating a circuit structure of an AMOLED driving circuit according to a second embodiment of the present invention.

FIG. 5 is an AMOLED driving circuit according to a second embodiment of the present invention. As shown in FIG. 5, the AMOLED driving circuit includes a control unit, a charging unit, a driving unit and a light emitting device D1. More specifically, the control unit includes a first switching transistor T4, a second switching transistor T5 and a third switching transistor T6. The charging unit includes a storage capacitor C1. The driving unit includes a first driving transistor T1, a second driving transistor T2 and a third driving transistor T3. The control unit is connected to a data line and a control line, and the control unit is connected to the driving unit via a first node 1, a second node 2 and a third node 3. The charging unit is connected to the driving unit via the first node 1, and the charging unit is connected to a first power source $V_{DD}$. The driving unit is connected to one end of the light emitting device D1, and the driving unit is connected to the first power source $V_{DD}$. The other end of the light emitting device D1 is connected to a second power source $V_{SS}$. When a first control signal flows in the control line, in response to the first control signal, the control unit controls a current from the data line so as to charge the charging unit through the driving unit. When a second control signal flows in the control line, in response to the second control signal, the control unit controls the charging unit so as to supply a driving voltage to the driving unit through the first node, so that the driving unit is driven by the driving voltage and then drives the light emitting device to emit light.

In this embodiment, the light emitting device D1 is an organic light emitting diode (OLED). The first driving transistor T1, the second driving transistor T2, the third driving transistor T3, the first switching transistor T4, the second switching transistor T5 and the third switching transistor T6 are P type thin film transistors, and a first electrode is a source and a second electrode is a drain.

More specifically, the control unit includes the first switching transistor T4, the second switching transistor T5 and the third switching transistor T6. The gate of the first switching transistor T4, the gate of the second switching transistor T5 and the gate of the third switching transistor T6 are connected to the control line. The source of the first switching transistor T4 and the source of the second switching transistor T5 are connected to the data line. The drain of the first switching transistor T4 and the source of the third switching transistor T6 are connected to the second node 2. The drain of the third switching transistor T6 is connected to the third node 3. The drain of the second switching transistor T5 is connected to the first node 1.

Further, the driving unit includes the first driving transistor Ti, the second driving transistor T2 and the third driving transistor T3. The gate of the first driving transistor Ti and the gate of the second driving transistor T2 are connected to the first node 1. The drain of the first driving transistor T1 and the drain of the second driving transistor T2 are connected to the first power source $V_{DD}$. The source of the first driving transistor T1 is connected to the second node 2. The drain of the third driving transistor T3 and the source of the second driving transistor T2 are connected to the third node 3. The gate of the third driving transistor T3 is connected to the first node 1. The source of the third driving transistor T3 is connected to the one end of the light emitting device D1.

Further, the charging unit includes the storage capacitor C1, one end of the storage capacitor C1 is connected to the first node 1, and the other end of the storage capacitor C1 is connected to the first power source $V_{DD}$.

In this embodiment, the first driving transistor T1, the second driving transistor T2, the third driving transistor T3, the first switching transistor T4, the second switching transistor T5 and the third switching transistor T6 are P type thin film transistor. The source of the third driving transistor T3 is connected to one end of the light emitting device D1, and the other end and of the light emitting device D1 is connected to the second power source $V_{SS}$. The voltage supplied by the second power source is reference voltage $V_{SS}$, and the voltage supplied by the first power source is $V_{DD}$. The voltage supplied by the first power source may be higher than the reference voltage $V_{SS}$, wherein $V_{DD}$ may be a high level, and accordingly, $V_{SS}$ as the reference voltage may be a low level. The voltage supplied by the data line is $V_{DATA}$, and the voltage supplied by the control line is $V_{SCAN}$. In addition, the first control signal is a low level of $V_{SCAN}$, and the second control signal is a high level of $V_{SCAN}$.

Operation principles of AMOLED driving circuit in this embodiment during a charging stage and a discharging stage are similar to those of the AMOLED driving circuit in the first embodiment, and the detailed description thereof will be omitted herein.

The AMOLED driving circuit in the first embodiment is different from that in the second embodiment in that, in the second embodiment, the thin film transistors are P type thin film transistors, further, the voltage supplied by the first power source is $V_{DD}$, the voltage supplied by the second power source is the reference voltage $V_{SS}$, and the voltage supplied by the first power source may be higher than the reference voltage. $V_{DD}$ may be the high level, and accordingly, $V_{SS}$ as the reference voltage may be the low level. In addition, the first control signal is the low level of $V_{SCAN}$, and the second control signal is the high level of $V_{SCAN}$.

The AMOLED driving circuit according to this embodiment includes the control unit, the charging unit, the driving unit and the light emitting device, which can effectively solve the problem of low charging speed of the AMOLED pixel due to low charging current, so that AMOLED display is suitable for condition of high resolution and high refresh frequency.

The AMOLED driving circuits of the above first and second embodiments are mainly used for driving AMOLED. In practical application, the AMOLED driving circuits of the above first and second embodiments are applied to polysilicon thin film transistors as well as other transistors.

Note that, in the present invention, in the transistors serving as the first driving transistor T1, the second driving transistor T2, the third driving transistor T3, the first switching transistor T4, the second switching transistor T5 and the third switching transistor T6, wherein, the first electrode and the second electrode are interchangeable to act as a drain and a source respectively. For example, since structures of the first electrode and the second electrode in the transistors are the same, the first electrode of a transistor may be the source depending on a position and a function of the transistor in the circuit in practical application, and accordingly, the second electrode may be the drain. Alternatively, the first electrode may be the drain and accordingly the second electrode may be the source.

In a third embodiment of the present invention, there is provided a driving method, the driving method may be based on an AMOLED driving circuit including a control unit, a charging unit, a driving unit and a light emitting device, the driving method includes:

Step 101, when a first control signal flows in a control line, in response to the first control signal, the control unit controls a current from a data line so as to charge the charging unit through the driving unit.

More specifically, the control unit includes a first switching transistor, a second switching transistor and a third switching transistor. The driving unit includes a first driving transistor, a second driving transistor and a third driving transistor. The charging unit includes a storage capacitor. The step of the control unit controlling a current from a data line so as to charge the charging unit through the driving unit includes: the first switching transistor, the second switching transistor and the third switching transistor are turned on under control of the first control signal in the control line, the first driving transistor and the second driving transistor are turned on, and the third driving transistor is turned off, so that the storage capacitor is charged by the data line through the first driving transistor and the second driving transistor in parallel.

Step 102, when a second control signal flows in the control line, in response to the second control signal, the control unit controls the charging unit so as to supply a voltage to the driving unit, so that the driving unit drives the light emitting device to emit light.

More specifically, the control unit includes the first switching transistor, the second switching transistor and the third switching transistor. The driving unit includes the first driving transistor, the second driving transistor and the third driving transistor. The charging unit includes the storage capacitor. The step of the control unit controlling the charging unit so as to supply a voltage to the driving unit so that the driving unit driving the light emitting device to emit light includes: the first switching transistor, the second switching transistor and the third switching transistor are turned off under control of the second control signal in the control line, the storage capacitor supplies a gate voltage to the second driving transistor and the third driving transistor, and the second driving transistor and the third driving transistor in series drive the light emitting device to emit light.

The driving method of the third embodiment may be implemented based on the AMOLED driving circuit in the above first embodiment or second embodiment, and the embodiment of the AMOLED driving circuit may be referred to the first or second embodiment. The embodiment of the step 101 may be referred to the charging stage of the AMOLED driving circuit in the first or second embodiment, and an embodiment of the step 102 may be referred to the discharging stage of the AMOLED driving circuit in the first or second embodiment, and detailed description thereof will be omitted herein.

In the third embodiment of the present invention, there is provided an AMOLED driving method, the AMOLED driving method may be based on an AMOLED driving circuit including a control unit, a charging unit, a driving unit, and a light emitting device. In response to the first control signal in a control line, the control unit controls a current from a data line so that the current charges the charging unit through the driving unit. In response to a second control signal in the control line, the control unit controls the charging unit so that the charging unit supplies a driving voltage to the driving unit, and so that the driving unit is driven by the driving voltage and then drives the light emitting device to emit light. In the driving circuit, the current for charging the charging unit may be increased by adjusting the current coefficients of the transistors in the driving unit, and thus the problem of low charging speed and long charging time of the AMOLED driving circuit charging for the capacitor may be effectively solved, so that the AMOLED driving circuit is suitable for AMOLED display in high resolution and high refresh frequency.

In a fourth embodiment of the present invention, there is provided a display device employing the AMOLED driving circuit in the above first or second embodiment, the embodiment of the AMOLED circuit may be referred to first or second embodiment, and detailed description thereof may be omitted herein.

In this embodiment, there is provided a display device employing an AMOLED driving circuit including a control unit, a charging unit, a driving unit, and a light emitting device, which can effectively solve the problem of low charging speed of the AMOLED pixel due to low charging current, so that AMOLED display is suitable for condition of high resolution and high refresh frequency.

It should be appreciated that the above embodiments are only the exemplary embodiments employed for illustrating the principle of the present invention, but the present invention is not limited thereto. It will be apparent to those skilled in the art that modifications and variations can be made without departing from the spirit and scope of the present invention, and these modifications and variations are also considered to fall within the scope of protection of the present invention.

The invention claimed is:

1. An AMOLED driving circuit, comprising:

a control unit, a charging unit, a driving unit, and a light emitting device, wherein an end of the charging unit is connected to a first node, and the other end of the charging unit is connected to a first power source;

the control unit includes a first switching transistor, a second switching transistor and a third switching transistor, wherein a gate of the first switching transistor, a gate of the second switching transistor and a gate of the third switching transistor are directly connected to a control line, and a first electrode of the first switching transistor and a first electrode of the second switching transistor are directly connected to a data line, and a second electrode of the first switching transistor and a first electrode of the third switching transistor are directly connected to a second node, a second electrode of the third switching transistor is directly connected to a third node, and a second electrode of the second switching transistor is directly connected to the first node;

the driving unit includes a first driving transistor, a second driving transistor and a third driving transistor, wherein a gate of the first driving transistor, a gate of the second driving transistor and a gate of the third driving transistor are connected to the first node, a first electrode of the first driving transistor is connected to the second node, and a first electrode of the third driving transistor is connected to an end of the light emitting device, and a first electrode of the second driving transistor and a second electrode of the third driving transistor are connected to the third node, and a second electrode of the first driving transistor and a second electrode of the second driving transistor are connected to the first power source; and the other end of the light emitting device is connected to a second power source.

2. The AMOLED driving circuit according to claim 1, wherein the first electrode is a drain and the second electrode is a source.

3. The AMOLED driving circuit according to claim 1, wherein the charging unit includes a storage capacitor, one end of the storage capacitor is connected to the first node, and the other end of the storage capacitor is connected to the first power source.

4. The AMOLED driving circuit according to claim 1, wherein the light emitting device comprises an organic light emitting diode (OLED).

5. The AMOLED driving circuit according to claim 1, wherein the first switching transistor, the second switching transistor and the third switching transistor are all P type thin film transistors.

6. The AMOLED driving circuit according to claim 1, wherein the first driving transistor, the second driving transistor and the third driving transistor are all P type thin film transistors.

7. The AMOLED driving circuit according to claim 1, wherein the second driving transistor operates in a linear region and the third driving transistor operates in a saturation region, during a light emitting stage of the light emitting device.

8. The AMOLED driving circuit according to claim 1, wherein a ratio between a data current of the data line and a driving current of the light emitting device is $$I_{DATA} / I_{OLED} = \frac{(K_2 + K_1) \cdot (K_2 + K_3)}{K_2 \cdot K_3},$$

where K1 is a current coefficient of the first driving transistor, K2 is a current coefficient of the second driving transistor, K3 is a current coefficient of the third driving transistor, IDATA is the data current supplied by the data line, and IOLED is the driving current that flows through the light emitting device.

9. A driving method of the AMOLED driving circuit according to claim 1, comprising:

turning on the first switching transistor, the second switching transistor and the third switching transistor by control of the control line, turning on the first driving transistor and the second driving transistor, and turning off the third driving transistor, so that the charging unit is charged by the data line through the first driving transistor and the second driving transistor in parallel; and turning off the first switching transistor, the second switching transistor and the third switching transistor under control of the control line, so that the charging unit supplies a gate voltage to the second driving transistor and the third driving transistor, and the second driving transistor and the third driving transistor in series drive the light emitting device to emit light.

10. A display device, including the AMOLED driving circuit according to claim 1.

11. The AMOLED driving circuit according to claim 1, wherein the first switching transistor, the second switching transistor and the third switching transistor are all N type thin film transistors.

12. The AMOLED driving circuit according to claim 1, wherein the first driving transistor, the second driving transistor and the third driving transistor are all N type thin film transistors.

* * * * *